US006520369B1

(12) United States Patent
Cytacki

(10) Patent No.: US 6,520,369 B1
(45) Date of Patent: Feb. 18, 2003

(54) NON-SLIP DRINKING VESSEL

(76) Inventor: Walter S. Cytacki, 157 Merriweather Rd., Grosse Pointe Farms, MI (US) 48236

( * ) Notice: Subject to any disclaimer, the term of this patent is extended or adjusted under 35 U.S.C. 154(b) by 0 days.

(21) Appl. No.: 09/693,492

(22) Filed: Oct. 20, 2000

(51) Int. Cl.[7] ..... B65D 25/24
(52) U.S. Cl. ..... 220/632; 220/636
(58) Field of Search ..... 220/632, 634, 220/636

(56) References Cited

U.S. PATENT DOCUMENTS

| | | | | | |
|---|---|---|---|---|---|
| 63,653 | A | * | 4/1867 | Rand | 220/632 |
| 526,460 | A | * | 9/1894 | Roennau | 220/632 |
| 2,018,271 | A | * | 10/1935 | Lewis | 220/632 |
| 3,143,243 | A | * | 8/1964 | MacKusick | 220/632 |
| 3,349,940 | A | * | 10/1967 | Cornelius | 220/632 |
| 4,625,881 | A | * | 12/1986 | Carlson | 220/632 |
| 5,657,871 | A | * | 8/1997 | Waters et al. | 220/632 |
| 5,823,334 | A | * | 10/1998 | Giovanni | 220/632 |

FOREIGN PATENT DOCUMENTS

| | | | | |
|---|---|---|---|---|
| FR | 417609 | * | 6/1910 | 220/632 |
| GB | 201689 | * | 6/1922 | 220/632 |

* cited by examiner

*Primary Examiner*—Joseph M. Moy
(74) *Attorney, Agent, or Firm*—Fildes & Outland, P.C.

(57) ABSTRACT

A drinking vessel includes an open top end; a bottom end; a side wall that extends from beyond the bottom end, and forming a peripheral edge, to the top end; and a non-slip member overmolded onto the bottom end, inward of the peripheral edge and extending below the peripheral edge, supporting the drinking vessel and inhibiting slippage of the vessel on a support surface.

4 Claims, 3 Drawing Sheets

NON-SLIP DRINKING VESSEL

TECHNICAL FIELD

This invention relates to drinking vessels and more particularly to a tumbler having a non-slip base feature that inhibits slipping of the vessel.

BACKGROUND OF THE INVENTION

It is known in the art relating to drinking glasses, both of plastic or glass construction, that they are easily slid on smooth surfaces such as a table or bar and that if a beverage within the glass is cold, condensation typically forms on the surface and runs down to the base. This condensation acts as a lubricant and makes the drinking glass more slidable. When the surface on which the glass is set is in motion, such as when the surface is on a boat, the sliding problem is exacerbated.

To alleviate this slippage, various devices have been used. These include a coaster on which the glass is placed and which may include a cork bottom, an o-ring insertable into the bottom of the glass, and insulators, which fit around the glass and are made from various materials.

SUMMARY OF THE INVENTION

The present invention provides a non-slip drinking vessel or glass that is less likely to slip on a supporting surface.

More specifically, such a drinking vessel includes an open top end; a bottom end; a side wall that extends from beyond the bottom end, and forming a peripheral edge, to the top end; and a non-slip member overmolded onto the bottom end, inward of the peripheral edge and extending below the peripheral edge, supporting the drinking vessel and inhibiting slippage of the vessel on a support surface.

In one arrangement, the non-slip member is overmolded onto at least a portion of the bottom end within the diameter of the peripheral edge. An adhesive may be disposed between the bottom end and the overmold to further ensure the connection between the bottom end and overmolded nonslip member.

In an alternative arrangement, the bottom end includes a circumferentially disposed channel adjacent the peripheral edge, which provides a receptacle for a greater amount of the non-slip member. Herein, the non-slip member can be defined by the material disposed in the channel or by material disposed in the channel and additional material disposed on the bottom end within the boundary of the channel.

Preferably, the drinking vessel is made of a plastic material exhibiting high clarity, good rigidity and strength, and good thermal stability. Preferable plastic materials include styrene acrylonitriles such as Lustranr SAN 31 manufactured by the Bayer Corporation. The overmolded non-slip member is also made of a plastic material exhibiting good frictional properties.

These and other features and advantages of the invention will be more fully understood from the following detailed description of the invention taken together with the accompanying drawings.

DETAILED DESCRIPTION OF THE INVENTION

Figure 1:
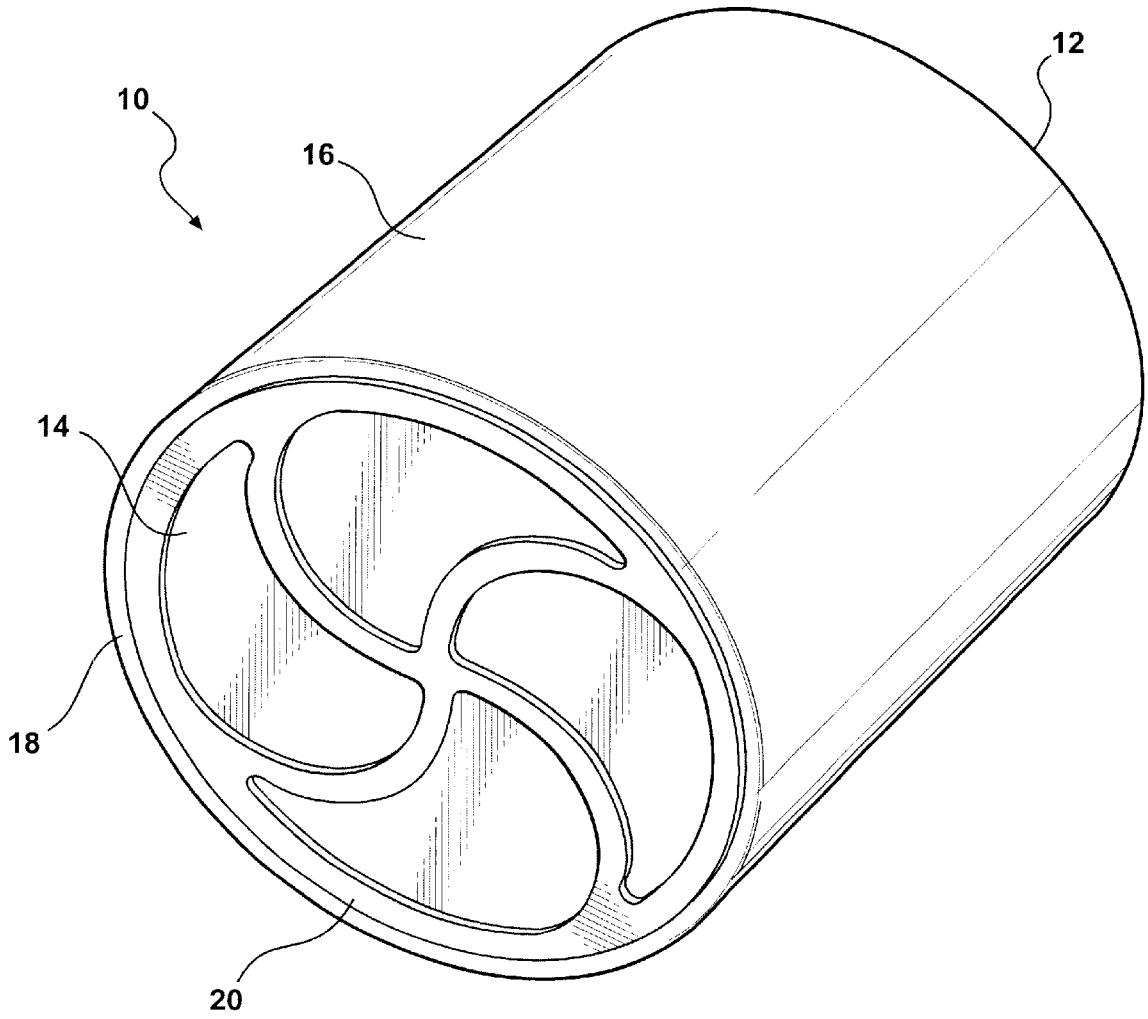
FIG. 1 is a perspective view of a drinking vessel constructed in accordance with the present invention illustrating a non-slip member attached on a bottom inward of the peripheral edge and extending below the peripheral edge.

Referring now to the drawings in detail, numeral 10 generally indicates drinking vessel or glass that is not likely to slip on a supporting surface. As is hereinafter more fully described, the glass 10 includes an open top end 12, a bottom end 14, and a side wall 16 that extends from beyond the bottom end, forming a peripheral edge 18, to the top end. A non-slip member 20 is attached on the bottom end 14, inward of the peripheral edge 18. The non-slip member 20 extends below the peripheral edge 18, and supports the vessel 10 while inhibiting slippage of the vessel on a support surface on which the vessel is placed.

In its simplest construction, the non-slip member 20 is an overmold of a gripping plastic or rubber material molded about the bottom end 14 within the boundary of the peripheral edge 18. In this and other embodiments, an adhesive 21, illustrated in phantom, may be disposed between the bottom end 14 and overmold 20 to assure the connection between the bottom end and the overmolded non-slip member.

Figure 2:
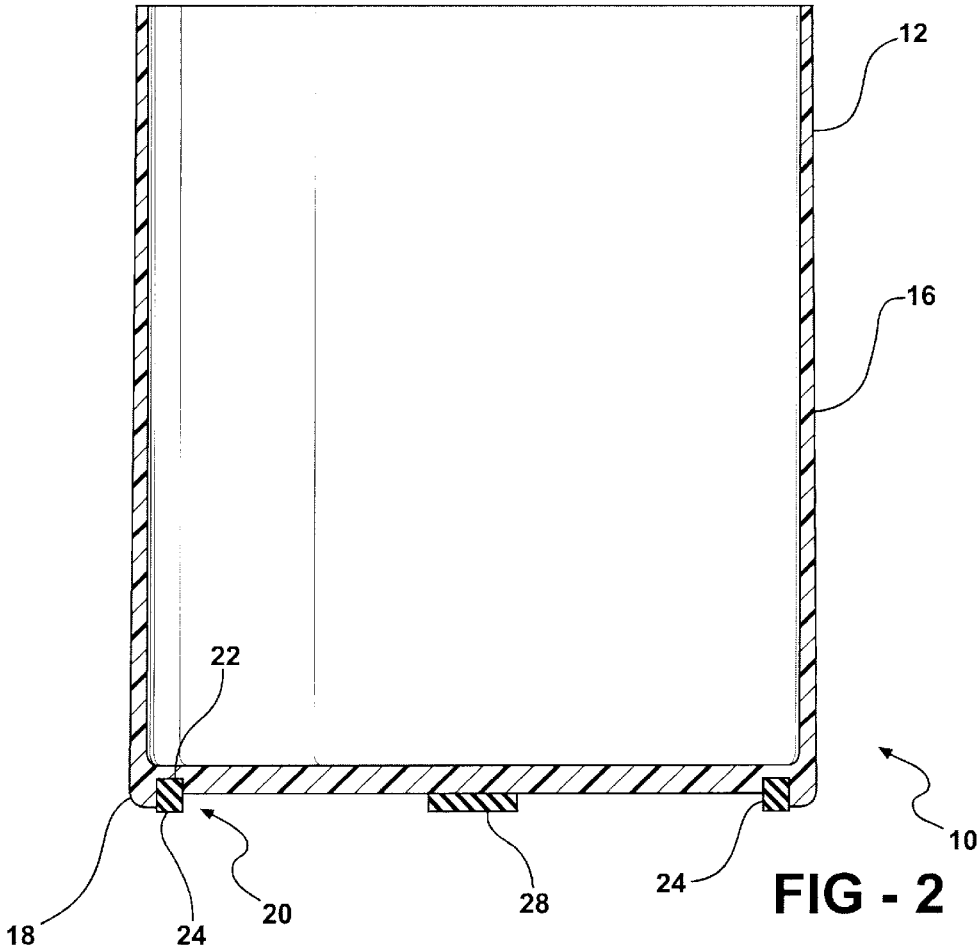
FIG. 2 is a sectional side view of a drinking vessel constructed in accordance with the present invention illustrating an exemplary embodiment of a non-slip member.
Figure 3:
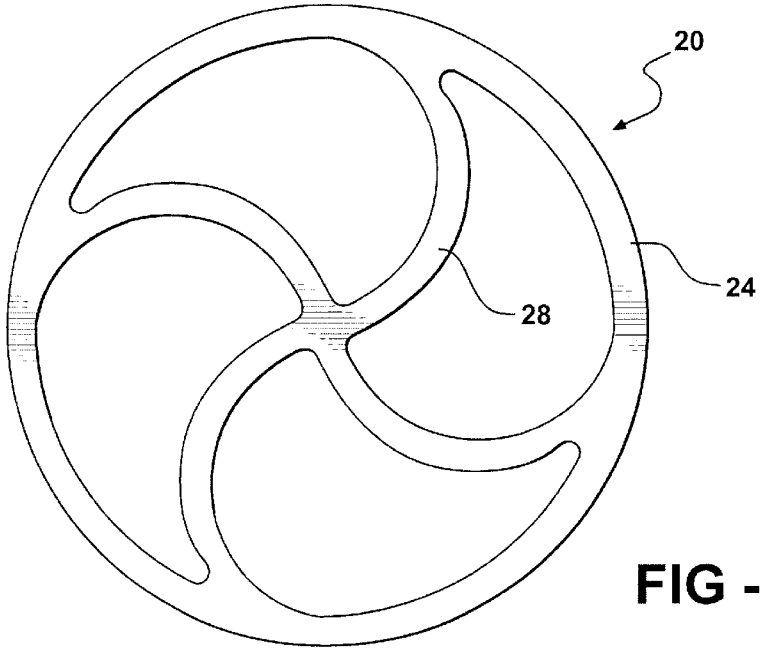
FIG. 3 is a plan view of one arrangement of the overmolded non-slip member.

In a preferable construction shown in FIG. 2, the bottom end 14 includes a circumferentially disposed channel 22 adjacent the peripheral edge 18 for facilitating retention of the non-slip member 20. Herein the non-slip member 20 includes a portion 24 disposed in the channel 22 and a web portion 28 disposed within the boundaries of the channel 22 to increase the surface area of the non-slip member 20. The non-slip member is shown in FIG. 3.

Figure 5:
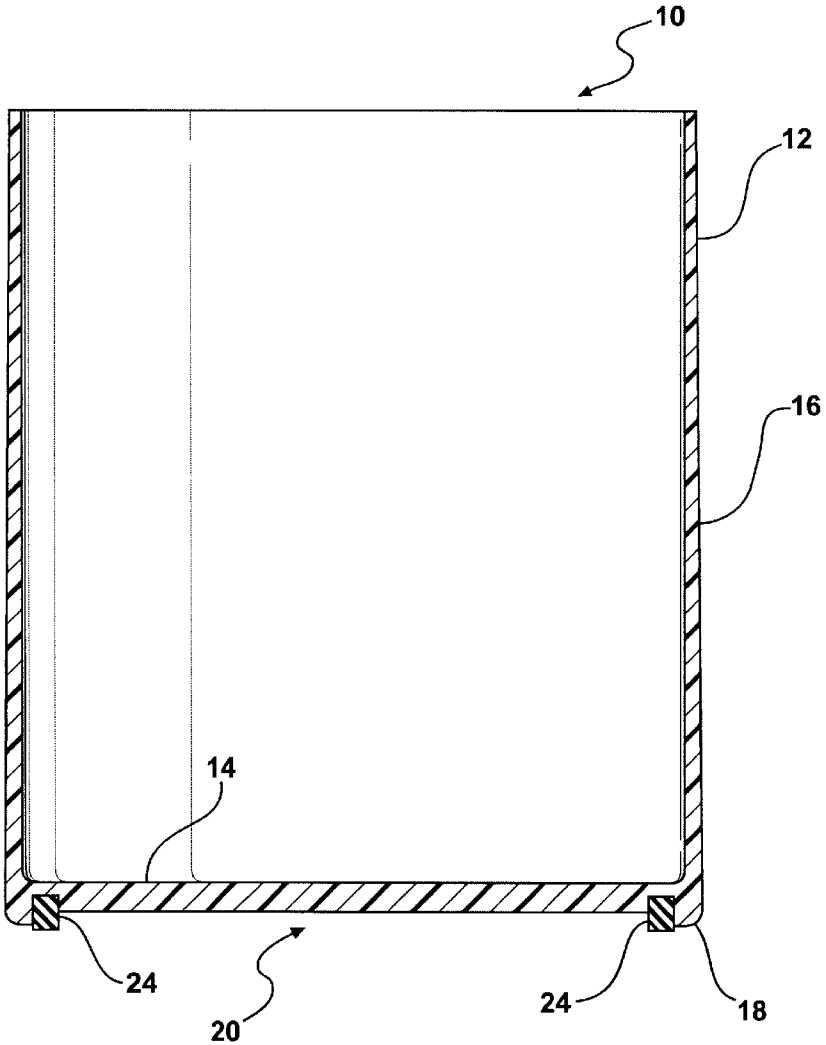
FIG. 5 is a sectional side view of a drinking illustrating an arrangement having a recess formed in the bottom end cooperating with the circumferentially disposed channel in the bottom end for receiving and retaining the overmolded non-slip member.
Figure 4:
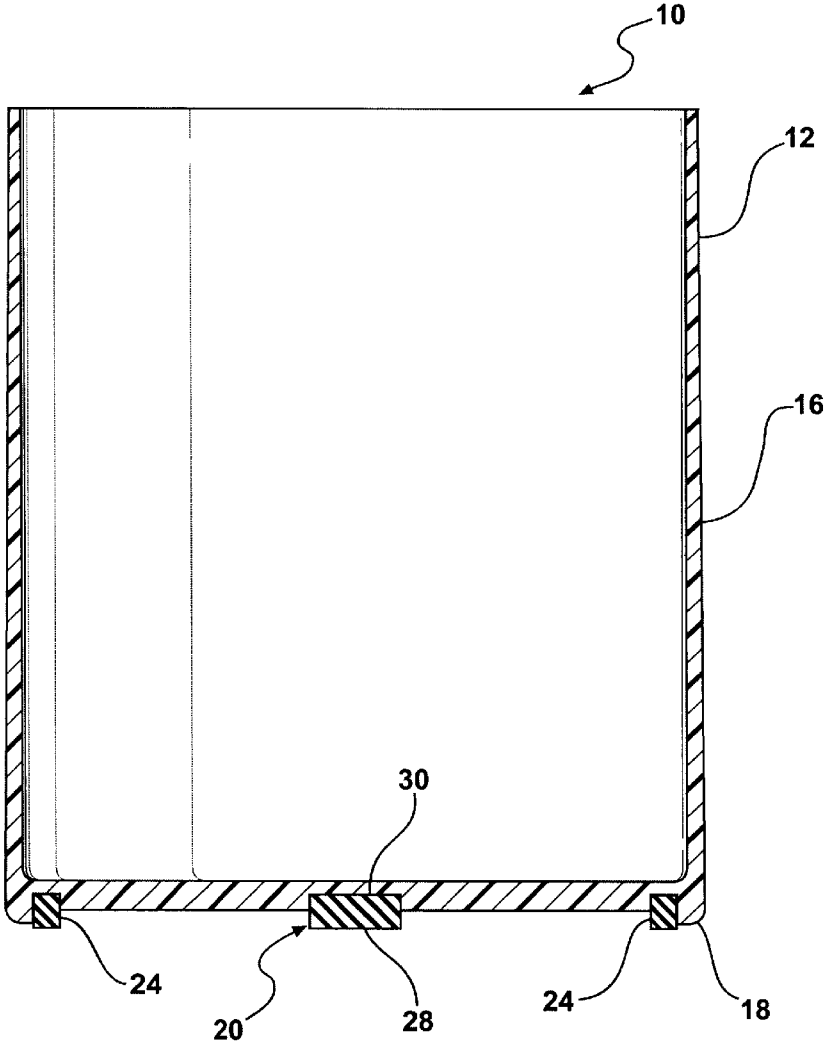
FIG. 4 is a sectional side view of a drinking illustrating an arrangement having an overmolded non-slip member that extends only within a circumferentially disposed channel in the bottom end.

FIG. 4 illustrates an arrangement wherein the overmolded non-slip member 20 extends only within the circumferentially disposed channel 22 in the bottom end 14. And FIG. 5 illustrating an arrangement wherein the bottom end 14 includes a recess 30 cooperating with the circumferentially disposed channel 22 for receiving and retaining the overmolded non-slip member 20.

Preferably, the drinking vessel 10 is made of a plastic material, which is easily molded, typically unbreakable and can be produced in a myriad of colors. An especially suitable plastic material includes styrene acrylonitriles such as Lustranr SAN 31 manufactured by the Bayer Corporation. The overmolded non-slip member is also made of a plastic material exhibiting good frictional properties.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A drinking vessel comprising:

an open top end;

a bottom end;

a side wall that extends from the top end downwardly beyond the bottom end, forming an outside peripheral edge below the bottom end;

a circumferentially disposed channel adjacent said peripheral edge; and a non-slip member including a ring portion fittable in said circumferentially disposed channel and a web portion extending from said ring portion across said bottom end and being overmolded onto the bottom end, inward of the outside peripheral edge and extending below the bottom end within and below the outside peripheral edge, supporting said drinking vessel and inhibiting slippage of said vessel on a support surface.

2. A drinking vessel as in claim 1 wherein an adhesive is disposed between said bottom end and said overmolded non-slip member.

3. A drinking vessel as in claim 1 wherein said drinking vessel is made of a plastic material.

4. A drinking vessel as in claim 3 wherein said plastic material includes styrene acrylonitriles.

* * * * *